US008122954B2

(12) United States Patent
Estes et al.

(10) Patent No.: US 8,122,954 B2
(45) Date of Patent: Feb. 28, 2012

(54) DOWNHOLE DEPTH COMPUTATION METHODS AND RELATED SYSTEM

(75) Inventors: Robert Estes, Tomball, TX (US); Jerry Cerkovnik, Highlands Ranch, CO (US); Gary J. Cresswell, Houston, TX (US); William J. Befeld, Richmond, TX (US)

(73) Assignee: Baker Hughes Incorporated, Houton, TX (US)

( * ) Notice: Subject to any disclaimer, the term of this patent is extended or adjusted under 35 U.S.C. 154(b) by 592 days.

(21) Appl. No.: 11/858,077

(22) Filed: Sep. 19, 2007

(65) Prior Publication Data

US 2008/0105423 A1 May 8, 2008

Related U.S. Application Data

(60) Provisional application No. 60/845,912, filed on Sep. 20, 2006.

(51) Int. Cl.
*E21B 47/09* (2006.01)

(52) U.S. Cl. ..... 166/255.1; 166/64; 166/66; 73/152.02

(58) Field of Classification Search ..... 166/255.1, 166/64, 66; 73/152.01, 152.02, 152.54
See application file for complete search history.

(56) References Cited

U.S. PATENT DOCUMENTS 2,221,767 A 11/1940 Hayward
3,504,370 A 3/1970 Rebilly
4,041,780 A * 8/1977 Angehrn ..... 73/152.02
4,734,860 A * 3/1988 Egli et al. ..... 702/6
4,739,325 A 4/1988 MacLeod
4,976,143 A 12/1990 Casso
5,019,978 A * 5/1991 Howard, Jr. et al. ..... 702/6
5,058,077 A 10/1991 Twist
5,230,387 A 7/1993 Waters et al.
5,274,552 A 12/1993 Milburn
5,341,886 A 8/1994 Patton
5,439,064 A 8/1995 Patton
5,581,024 A 12/1996 Meyer, Jr. et al.
5,732,776 A 3/1998 Tubel et al.
5,812,068 A * 9/1998 Wisler et al. ..... 340/855.5
5,813,480 A 9/1998 Zaleski, Jr.
5,896,939 A 4/1999 Witte
6,046,685 A 4/2000 Tubel
(Continued)

FOREIGN PATENT DOCUMENTS

EP 0361996 A1 4/1990
(Continued)

*Primary Examiner* — William P Neuder
*Assistant Examiner* — Robert E Fuller
(74) *Attorney, Agent, or Firm* — Mossman, Kumar & Tyler, PC

(57) ABSTRACT

A method for determining depth in a wellbore uses inertial navigation in conjunction with a database having one or more measured parameters correlated with depth. The measured parameter may be the lengths of stands forming a drill string, prior survey data relating to a naturally occurring feature such as formation lithology, or data relating to a human made feature such as collars in a casing string. The downhole processor may use accelerometer measurements to calculate a measured depth of a BHA and access the database to retrieve a predicted depth that corresponds with one or more sensor measurements (e.g., motion indicating the addition of a stand to a drill string). Thereafter, if the downhole processor determines that the predicted depth is in agreement with the calculated depth, the processor stores the predicted depth and/or associates the predicted depth with directional surveys taken along the wellbore.

22 Claims, 4 Drawing Sheets

FIG. 2

U.S. PATENT DOCUMENTS

| | | | | |
|---|---|---|---|---|
| 6,109,370 | A | 8/2000 | Gray | |
| 6,173,793 | B1 | 1/2001 | Thompson et al. | |
| 6,516,898 | B1 * | 2/2003 | Krueger | 175/50 |
| 6,618,675 | B2 * | 9/2003 | Strickland | 702/6 |
| 6,736,221 | B2 * | 5/2004 | Chia et al. | 175/45 |
| 6,769,497 | B2 * | 8/2004 | Dubinsky et al. | 175/27 |
| 7,181,960 | B2 * | 2/2007 | Sheng et al. | 73/152.05 |
| 7,254,486 | B2 * | 8/2007 | Guo | 702/8 |
| 2005/0060096 | A1 | 3/2005 | Hutchinson | |
| 2005/0160812 | A1 | 7/2005 | Ekseth et al. | |
| 2005/0269106 | A1 | 12/2005 | Wilson et al. | |
| 2008/0257546 | A1 * | 10/2008 | Cresswell et al. | 166/250.15 |
| 2009/0173538 | A1 * | 7/2009 | Estes et al. | 175/24 |

FOREIGN PATENT DOCUMENTS

| | | | |
|---|---|---|---|
| WO | 02/103158 | A1 | 12/2002 |

* cited by examiner

DOWNHOLE DEPTH COMPUTATION METHODS AND RELATED SYSTEM

CROSS-REFERENCE

This application claims priority from U.S. Provisional Application Ser. No. 60/845,912 filed on Sep. 20, 2006.

FIELD OF THE DISCLOSURE

1. Field of the Disclosure

The disclosure relates to a method and an apparatus for the underground determination of the depth of a bore drilled in a subterranean rock formation.

2. Background of the Disclosure

Hydrocarbons are recovered from underground reservoirs using wellbores drilled into the formation bearing the hydrocarbons. Prior to and during drilling, extensive geological surveys are taken to increase the likelihood that the drilled wellbore intersects the formations of interest. While current surveying techniques and devices provide increasingly accurate wellbore profile data, wellbores drilled in the past may not have had accurate wellbore surveys taken either because the technologies were not available or for other reasons such as cost. Due to advancements in drilling technology, some of these older wells may now be reworked in order to recover hydrocarbon not previously economically accessible. These workover procedures, however, require accurate surveys to insure that a particular operation, e.g., a branch bore, is drilled at the correct depth or the wellbore trajectory does not trespass into adjacent property.

Typically, surveys of drilled wells are done by determining the actual displacement coordinates (north, east, vertical) at the bottom of a conveyance devices such as a wireline or tubing string, which are derived from incremental azimuth and inclination values. In one conventional method, a wireline truck or other surface platform lowers a directional instrument into the well. As the instrument travels in the well, it takes taking measurements of angular orientation at discrete intervals. Data is communicated to the surface by wireline in real time and/or data is extracted from the instrument at the surface by accessing a resident memory module. At the surface, a computer matches the "survey vs. time" downhole data set with the "depth vs. time" surface data set. Thereafter, iterative computation at the surface produces the final "survey log" for the well. Such a wireline survey necessitates a trip into the wellbore prior to drilling, which consumes time and resources. The present disclosure addresses these and other drawbacks of the prior art.

SUMMARY OF THE DISCLOSURE

In aspects, the present disclosure provides a method for determining depth of a wellbore tool in a wellbore drilled in a subterranean formation. One illustrative method includes forming a database having a selected parameter associated with depth; programming a memory module of a processor with the database; conveying the wellbore tool and the processor into the wellbore; measuring acceleration of the wellbore tool; and determining the depth of the wellbore tool using the processor by processing the acceleration measurements and accessing the database. The database may include data relating to one or more of measured lengths of tubulars making up the drill string, a measured parameter of a naturally occurring feature, and/or a measured parameter of a human made feature in the wellbore.

The method may also include surveying the wellbore and associating the survey data with the determined depth. Exemplary equipment for surveying the wellbore include, but not limited to, a gyroscopic survey instrument, magnetometers, accelerometers, mechanical inclination measurement devices such as plumb bobs, and magnetic directional survey instruments. Illustrative survey data may include azimuth and inclination. This survey data may be processed to produce a set of total displacement values for the wellbore tool by calculating incremental displacements for north, east, and vertical. In some arrangements, an orientation of the wellbore tool may be determined at a plurality of discrete locations using the survey tool. The determined orientations may be associated with the determined depth for each of the plurality of discrete locations. Other arrangements may utilize a continuous determination of an orientation of the wellbore tool using a survey tool. In certain embodiments, the processor may determine a first depth value by processing the acceleration measurements and accessing the database to obtain a second depth value. The accessing may involve retrieving a predicted depth value or processing the data retrieved from the database to arrive at a predicted depth value. Thereafter, the processor may compare the first depth value to the second depth value to determine the depth of the wellbore tool.

In aspects, the present disclosure also provides an apparatus for determining depth in a wellbore drilled in a subterranean formation. The apparatus may include a wellbore tool configured to traverse the wellbore; an accelerometer positioned on the wellbore tool; a memory module programmed with data relating to a previously measured parameter of interest; and a processor in communication with the accelerometer and the memory module. The processor may determine the depth of the wellbore tool using measurements made by the accelerometer and using the data in the memory module. The wellbore tool may be a drop survey tool, a wireline conveyed tool, a BHA conveyed via a rigid conveyance device such as a drill string, a tractor conveyed tool and/or an autonomous drilling device.

In aspects, the present disclosure also provides a system for determining depth in a wellbore drilled in a subterranean formation. The system may include a drill string configured to convey a bottomhole assembly (BHA) into the wellbore; an accelerometer positioned on the drill string; a memory module programmed with data relating to a previously measured parameter of interest; and a processor in communication with the accelerometer and the memory module. The processor may be configured to determine the depth of the BHA using measurements made by the accelerometer and the data in the memory module. In embodiments, the system may include a survey tool positioned on the drill string. The processor may be further configured to associate measurements of the survey tool with the determined depth.

In aspects, the present disclosure provides methods and systems for determining depth in a wellbore drilled in a subterranean formation without undertaking a separate survey trip. In one embodiment, a drill string provided with a bottomhole assembly (BHA), surveying tools and motion sensors are conveyed into the wellbore. At discrete locations, a processor, which can be downhole or at the surface, determines the distance traveled by the drill string using acceleration data provided by suitable motion sensors. The total distance traveled by the drill string at each discrete location is generally considered the depth of the BHA at each discrete location. Also, while the drill string is stationary, the on-board survey tools measure parameters relating to the orientation of the BHA, e.g., azimuth and inclination at these discrete locations. A gyroscopic survey instrument can take these measurements when in casing while a magnetometer can be used in open hole. Thereafter, the processor associates or correlates the survey measurements to the determined depth at each discrete location where the surveys are taken.

In one embodiment, utilizing preprogrammed instructions, the processor processes the accelerometer data to determine whether a discrete location has been reached and the distance traveled by the BHA to reach that discrete location. For example, the motion sensors can include accelerometers that measure acceleration along axes parallel (i.e., the z-axis) and orthogonal (i.e., x-axis and y-axis) to the longitudinal axis of the wellbore. The processor can monitor the accelerometer data for a silent period that would indicate that the drill string has stopped moving. In one arrangement, the processor continually performs a double integration of the z-axis acceleration data while the drill string is in motion to calculate the incremental distance traveled by the drill string. The summation is stopped once the accelerometer data indicates that the drill string has stopped moving. In another configuration, once an interruption in drill string motion is detected, the processor performs a double integration of recorded measurements made by the z-axis accelerometer to determine the distance traveled by the drill string to each discrete location, which then yields the depth at each discrete location. This would be a variation on inertial navigation that uses an accelerometer or accelerometers and a gyroscope to continually integrate and accumulate net displacement. In such a system of wellbore inertial navigation, ring laser gyro tool (e.g., the RIGS Tool offered by BAKER HUGHES INCORPORATED), there is a requirement for aiding using an external aiding reference signal. With wireline inertial navigation, that aiding comes from the wireline depth, which is measured at the surface. In an MWD embodiment, depth is not known downhole where the integration is being accumulated. In this case, aiding can be established using zero velocity updates, which can be detected using motion sensors or timing signals.

The processor can process the incrementally determined depths and the survey parameters (azimuth and inclination values) for each discrete location to produce a set of total displacement figures for the BHA and drill string. In some embodiments, the incremental north, east and vertical values are written to a memory module disposed in the drill string. In other embodiments, these values can be periodically transmitted to the surface using a suitable communication link (e.g., mud pulse, data conductors, EM transmission, etc.)

In embodiments, the drill string includes a downhole memory module programmed with the lengths of the tubulars forming the drill string. The processor keeps track of the number of tubular joints making up the drill string and sums the preprogrammed lengths of these tubulars to determine depth at each discrete location. Advantageously, the processor can compare the tubular length-based calculated depth value to the accelerometer-based calculated depth value to confirm the accuracy of these measurements.

In still other embodiments, a computer readable medium can be used in conjunction with embodiments system for measuring depth in a subterranean wellbore. For example, the medium can include instructions that enable determination of depth at discrete locations along the wellbore using the acceleration measurements. Suitable mediums include ROM, EPROM, EAROM, EEPROM, flash memories, and optical disks.

Examples of the more important features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE FIGURES

For detailed understanding of the present disclosure, reference should be made to the following detailed description of the preferred embodiment, taken in conjunction with the accompanying drawing.

DETAILED DESCRIPTION OF THE INVENTION

Figure 1:
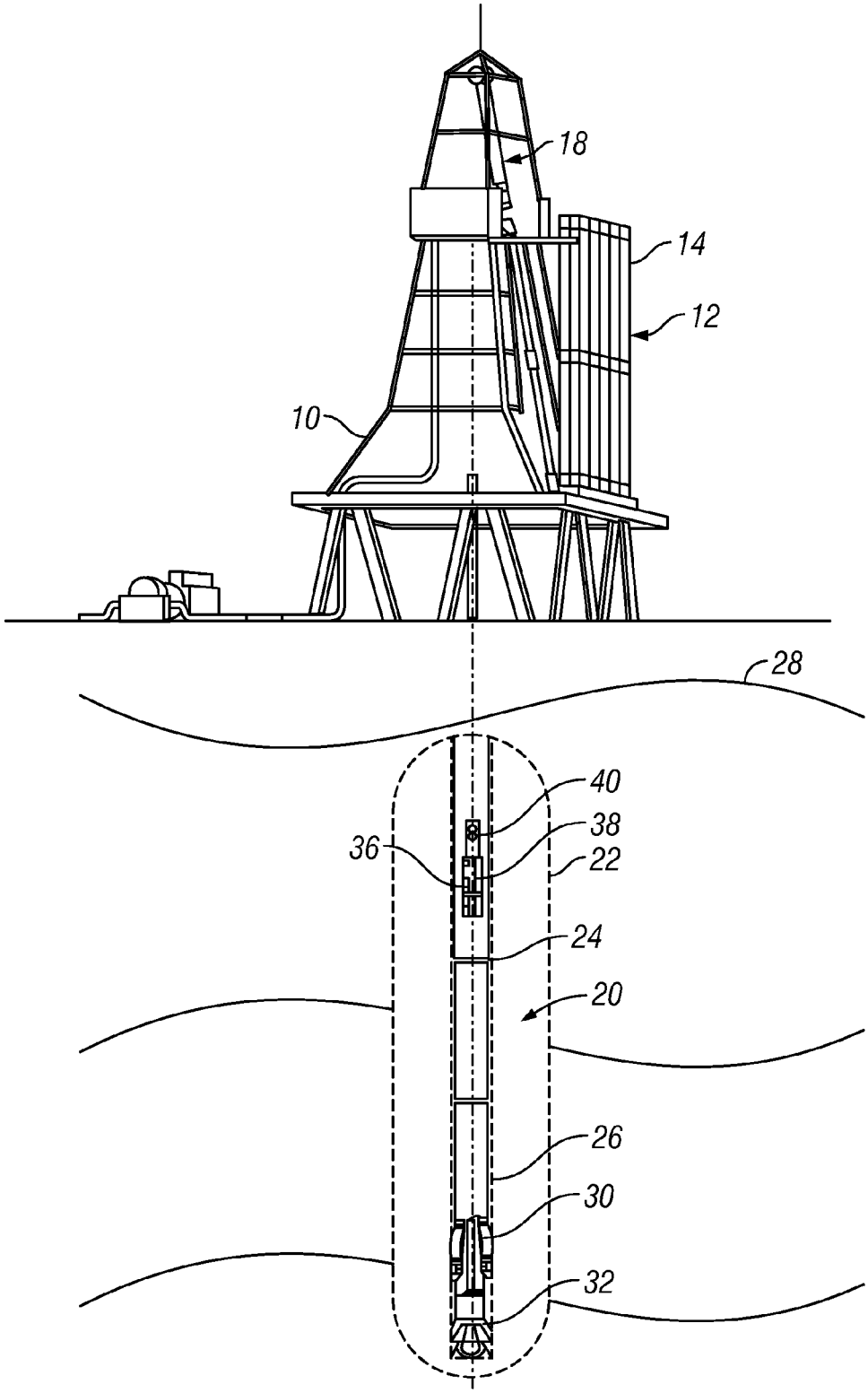
FIG. 1 schematically illustrates an elevation view of a drilling system utilizing downhole depth measurement in accordance with one embodiment of the present disclosure.

The present disclosure relates to devices and methods for downhole determination of depth. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown a conventional drilling tower 10 for performing one or more operations related to the construction, logging, completion or work-over of a hydrocarbon producing well. While a land well is shown, the tower or rig can be situated on a drill ship or another suitable surface workstation such as a floating platform or a semi-submersible for offshore wells. The tower 10 includes a stock 12 of tubular members generally referred to as drill string segments 14, which are typically of the same and predetermined length. The tubulars 14 can be formed partially or fully of drill pipe, metal or composite coiled tubing, liner, casing or other known members. Additionally, the tubulars 14 can include a one way or bidirectional communication link utilizing data and power transmission carriers such fluid conduits, fiber optics, and metal conductors. The tubulars 14 are taken from the rod stock 12 by means of a hoist or other handling device 18 and are joined together to become component parts of the drill string 20. In embodiments, the tubular 14 may be "stands." As is known, a stand may include a plurality of pipe joints (e.g., three joints). At the bottom of the drill string 20 is a bottomhole assembly (BHA) 22 illustrated diagrammatically in the broken-away part 24 that is adapted to form a wellbore 26 in the underground formation 28. The BHA includes a housing 30 and a drive motor (not shown) that rotates a drill bit 32.

The BHA 22 includes hardware and software to provide downhole "intelligence" that processes measured and preprogrammed data and writes the results to an on-board memory and/or transmits the results to the surface. In one embodiment, a processor 36 disposed in the housing 30 is operatively coupled to one or more downhole sensors (discussed below) that supply measurements for selected parameters of interest including BHA or drill string 20 orientation, formation parameters, and borehole parameters. The BHA can utilize a downhole power source such as a battery (not shown) or power transmitted from the surface via suitable conductors. A processor 36 includes a memory module 38 to receive predetermined data and is programmed with instructions that evaluate and process measured parameters indicative of motion of the drill string 20. Based on these motion-related parameters and preprogrammed data, the processor 36 determines the depth and position, i.e., north, east and vertical, of the BHA 22 in the wellbore. As used herein the term "north" refers to both magnetic north and geographic north.

It should be understood that the BHA 22 is merely representative of wellbore tooling and equipment that may utilize the teachings of the present disclosure. That is, the devices and methods for downhole depth measurement of the present disclosure may also be used with other equipment, such as survey tools, completion equipment, etc.

Figure 2:
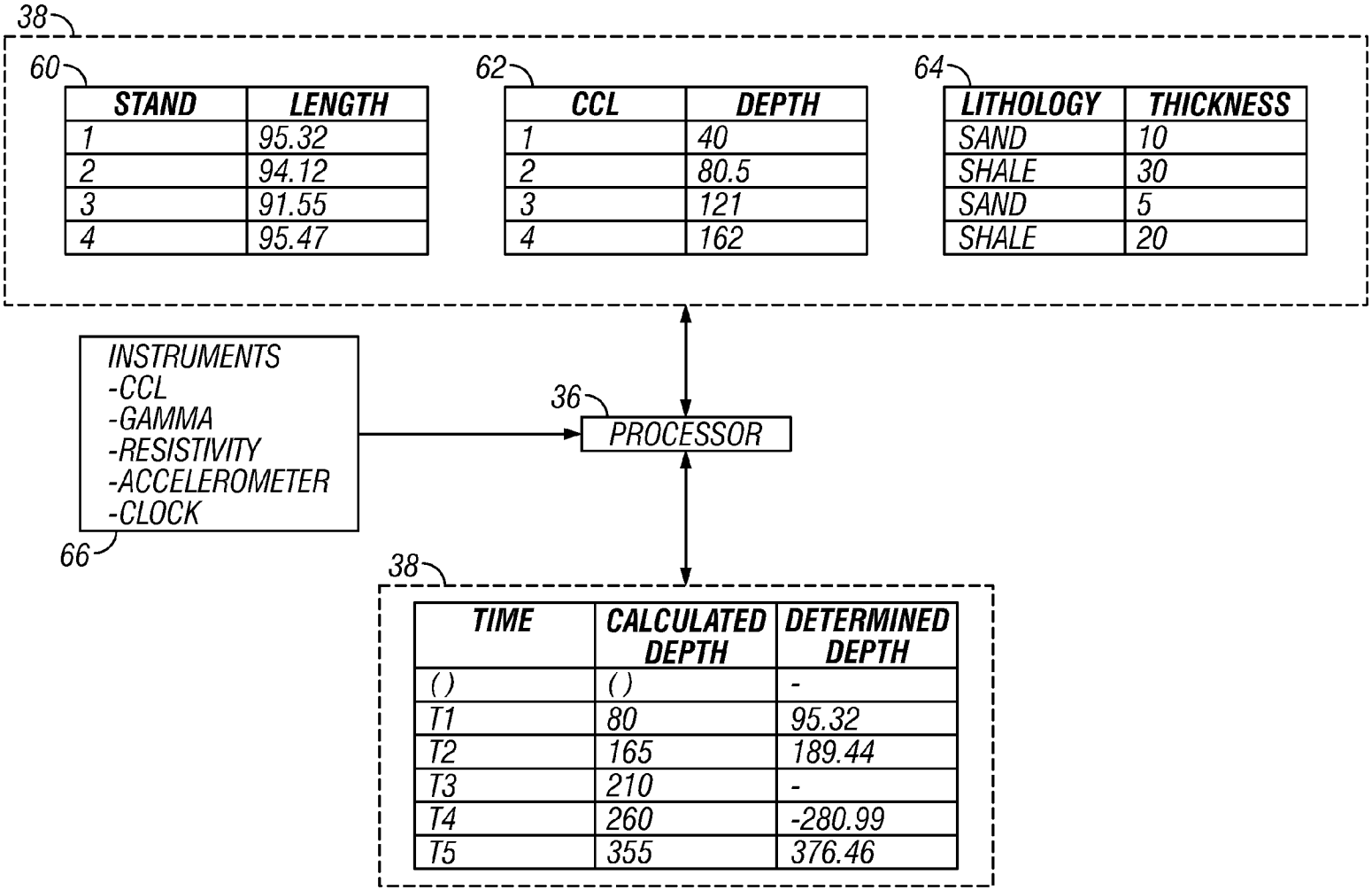
FIG. 2 functionally illustrates a processor and associated databases in accordance with one embodiment of the present disclosure.

Referring now to FIG. 2, in embodiments, the processor 36 may be programmed to determine depth using inertial navigation techniques in conjunction with one or more databases 60, 62, 64 having one or more measured parameters that may be correlated directly or indirectly with depth. By way of illustration, the database 60 may include the lengths of stands forming a drill string 20. The database 60 provides an indirect predicted depth because the individual stand lengths must be added to obtain the predicted depth. The database 62 may include data relating to the successive depths of collars along a well casing, and the database 64 includes survey data relating to the thickness of particular geological layers in a formation. Generally speaking, however, the measured parameters may relate to human made features such as wellbore tooling/equipment and wellbore geometry or a naturally occurring features such as formation lithology. Moreover, the inclusion of three databases 60, 62 and 64 is merely for simplicity in explanation. Any number of databases, e.g., one or more than three, may be used. One or more instruments 66 may provide the downhole processor 36 with measurements that may be used to query the databases 60, 62, 64 to retrieve depth data. The retrieved depth data may directly provide a predicted depth for the BHA or may be used to calculate a predicted depth for the BHA 22.

For example, the instruments 66 may include accelerometers and a clock that may be used to detect a period of no drill string movement that is indicative of the adding of a stand to the drill string 20. Upon detecting such a period, the processor 36 may query the database 60 to retrieve a stand length when the accelerometer and clock data indicate that a stand has been added. The database 60 may include the pre-measured length of each stand to be added to the drill string 20 and the order in which each stand is to be added to the drill string 20. Thus, the processor 36 may maintain a historical record of the number of stands added to the drill string 20 and query the database 62 to retrieve the length for successive stands upon detection of quiet period. Thereafter, the processor 36 may sum the lengths of the stands added to the drill string 20 to arrive at a predicted depth.

In another example, an instrument 66 such as a casing collar locator (CCL) may transmit signals indicating that a casing collar has been detected. The processor 36 may maintain a historical record of the number of casing collars that have been detected and query the database 62 to retrieve depth data for the most recent collar located. That is, for instance, if three collars have previously been detected, then the processor 36 queries the database for the depth of the fourth collar upon receiving the appropriate signal from the casing collar locator. In this case, retrieved depth may be the predicted depth of the BHA 22. Human made features may include features beyond wellbore tooling and equipment. For example, a human made feature may also encompass an inclination of the wellbore. In this regard, the inclination of a wellbore may be considered a human engineered feature. Thus, a database (not shown) can associate depth values for pre-measured inclination values.

In yet another example, one or more formation evaluation tools may detect a transition into a shale layer or a sand layer. The processor 36, as before, may maintain a historical record of the different layers and formations that have been traversed by the BHA 22 and query the database 62 to retrieve depth data associated with the next anticipated layer. Thereafter, the processor 36 may sum the thickness of the layers that have been traversed to arrive at a predicted depth for the most recently detected lithological characteristic. The database 62 may include geological data, geophysical data, and/or lithological data such as gamma ray, resistivity, porosity, etc. from the wellbore being traversed or survey data taken from an offset wellbore.

Along with retrieving and/or calculating a predicted depth as described above, the downhole processor 36 may also calculate a depth of the BHA 22 using inertial navigation techniques. If the downhole processor 36 determines that there is sufficient agreement with between the predicted depth and the calculated depth, the downhole processor 36 uses the predicted depth for subsequent operations. For example, the predicted depth may be stored for future reference, may be associated with directional data, and/or used for wellbore path or trajectory calculations. Embodiments of methods and devices utilizing inertial navigation, together with survey operations, are described in greater detail below.

Referring now to FIG. 1, in one embodiment, the BHA 22 includes sensors, generally referenced with numeral 40 that, in part, measures acceleration in the x-axis, y-axis, and z-axis directions. For convenience, the x-axis and y-axis directions describe movement orthogonal to the longitudinal axis of the drill string 20, and the z-axis direction describes movement parallel to the longitudinal axis of the drill string 20. In one suitable arrangement, the package uses a two axis gyro and three accelerometers to provide the necessary data for orientation in a magnetic environment. One such package or module, GYROTRAK, is made by BAKER HUGHES INCORPORATED. Additionally, a magnetometer, which measures the strength or direction of the Earth's magnetic, can be used when the BHA 22 is outside of the magnetic environment, i.e., in open hole. Other instruments include mechanical devices such as plumb bobs and electronic equipment such as magnetic directional survey equipment.

The processor 36 and the sensor package 40 cooperate to determine the depth and orientation of the BHA 22 by identifying start and stop events for drill string 20 motion and calculating the velocity and distance traveled by the drill string 20 between the start and stop events. As used herein, the term "depth" means measured depth, or the length of the wellbore as opposed to the vertical depth of the wellbore. In a conventional manner, during tripping of the drill string 20 into the wellbore, the motion of the drill string 20 is interrupted so that a tubular joint can be added to the drill string 20. Thereafter, the motion of the drill string 20 resumes until the next tubular joint 14 is added to the drill string 20. Thus, the start and stop events are generally indicative of when a joint of a tubular 14 has been added to the drill string 20. Additionally, since the length of each tubular 14 is known, an estimate can be made of the distance traveled by the drill string 20 between the start and stop events by summing together the lengths of all the tubulars 14 added to the drill string 20 between the start and stop events. The length of the tubulars, which can be measured or assumed values, can be programmed into the memory module 38 for the processor 36 as previously described.

Figure 3:
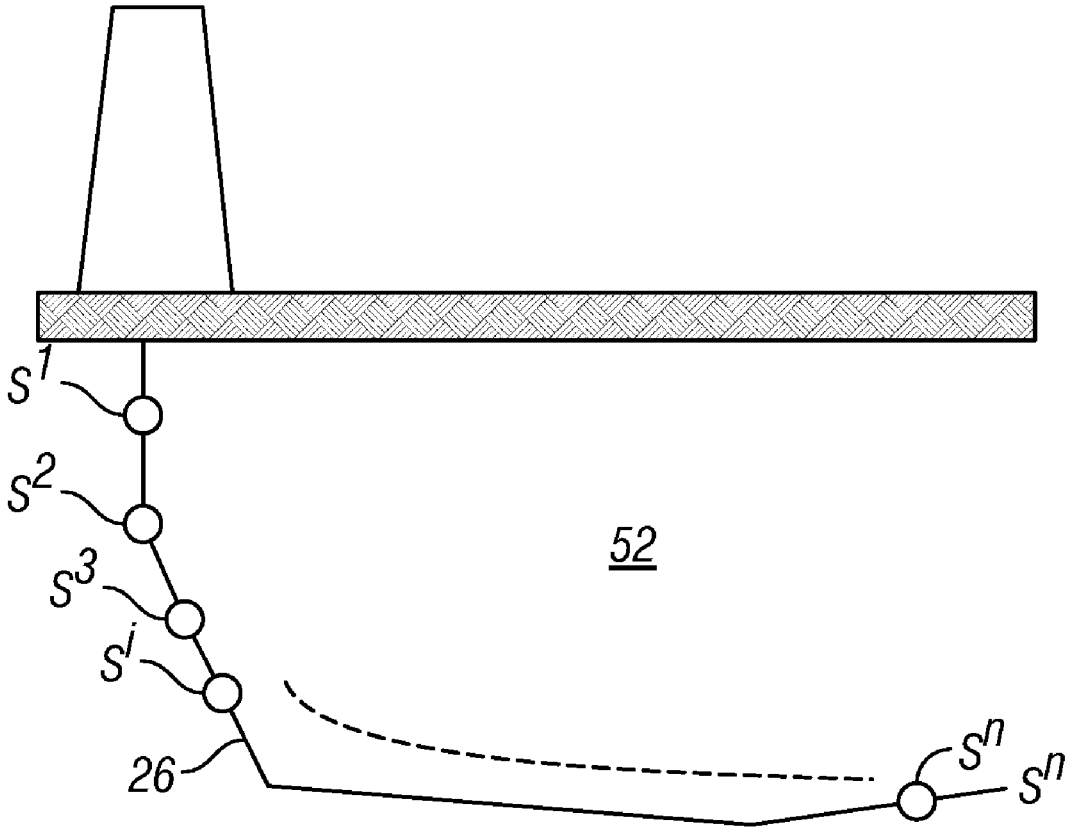
FIG. 3 illustrates a wellbore trajectory having discrete survey points.

Referring now to FIG. 3, there is shown a wellbore 26 drilled in an earthen formation 52 by a BHA 22 such as that shown in FIG. 1. As the BHA 22 runs in the wellbore, drill string motion is periodically interrupted to add consecutive lengths of tubing 14 to the drill string 20. Exemplary stopping positions are labeled $S^1$, $S^2$, $S^3$, $S^i$, and $S^n$, for convenience. At each stopping station or position $S^i$, the processor 36 initiates a directional survey using the on-board direction sensors 40. These sensors 40 can be used to determine north, east, and inclination of the BHA 22. The survey data is then associated or correlated with the determined depth at each location $S^i$. These "snapshot" survey stations with their time-of-day data in memory are written to the onboard memory module 38 and/or transmitted to the surface.

Figure 4A:
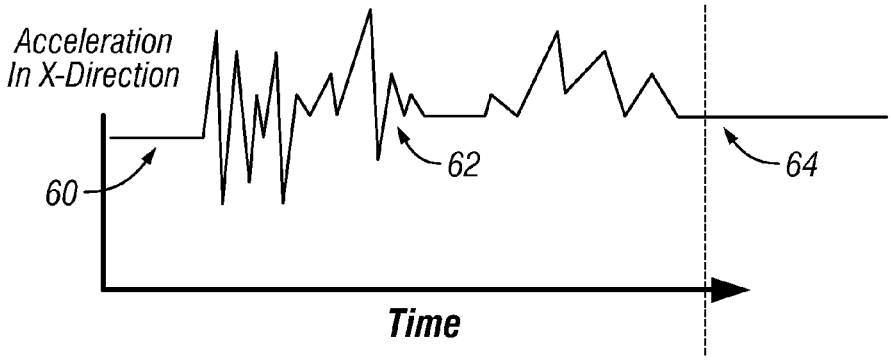
FIGS. 4A-C are illustrative charts of accelerometer measurements in the x-axis, y-axis and z-axis directions.
Figure 4B:
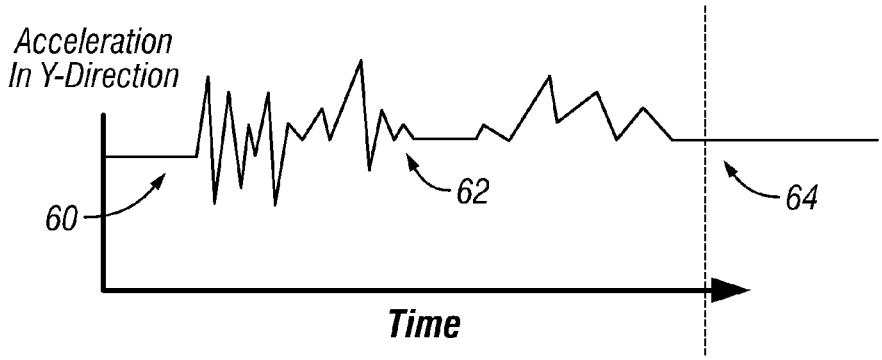
Figure 4C:
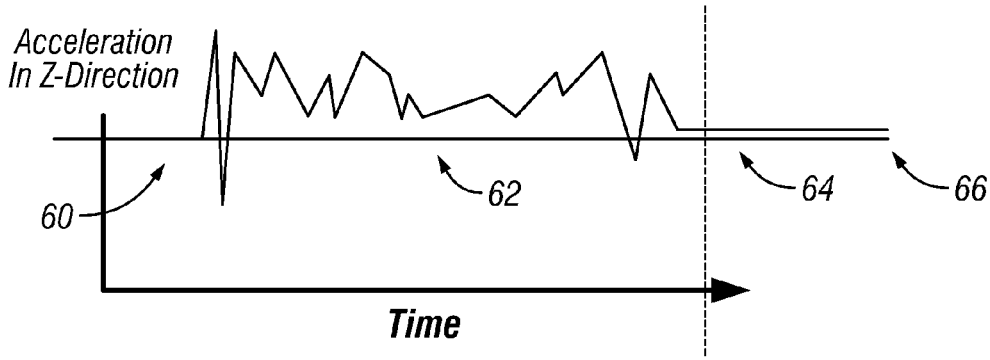

To determine depth at each location $S^i$, the processor 36, using appropriate programmed instructions, detects motion and interruptions in motion by, in part, using the measurements provided by the sensors 40, which include multi-axis accelerometers and other sensors. For example, during travel between the stopping positions S, acceleration measurements taken by the accelerometers are transmitted to the processor 36. Referring now to FIGS. 4A-C, there are shown illustrative graphs of accelerometer measurements from the x-axis, y-axis, and z-axis directions, respectively. As can be seen, a drill string 20 start event and subsequent motion causes the drill string 20 to accelerate, which is recorded by the accelerometers. Typically, a start event, which is generally indicated by arrow 60, is initiated by pulling the drill string 20 slightly uphole. Thereafter, the x-axis and y-axis accelerometers measure drill string 20 vibration orthogonal to the longitudinal axis as the drill string 20 moves through the wellbore 26, this portion being generally indicated by arrow 62. The z-axis accelerometer measures acceleration in the direction of drill string 20 movement during the portion indicated by arrow 62. A "silent" period, shown by arrow 64, follows a stop in drill string 20 motion wherein the accelerometers do not measure any motion of significance. The halt in downward movement of the drill string 20 can also be confirmed by the absence of changes in other sensors, such as gyroscopes, magnetometers, and resistivity sensors. As indicated previously, during the "silent" period, the appropriate directional surveys are taken.

Figure 4D:
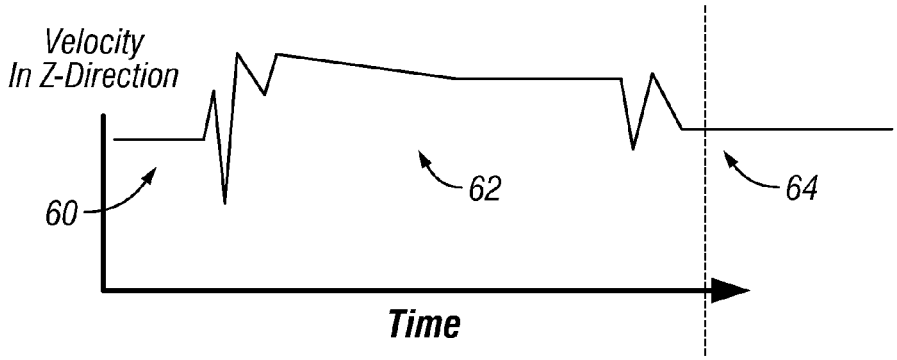
FIG. 4D is an illustrative chart of calculated velocity based on measured z-axis-axis accelerometer measurements.

With respect to the measurements from the z-axis-accelerometer, integrating the measured acceleration values in the z-axis direction over a predetermined time period yields velocity, which is illustratively shown in FIG. 4D. Thus, in one embodiment, utilizing preprogrammed instructions, the processor 36 performs a double integration utilizing the z-axis accelerometer measurements to calculate incremental distance traveled during each measurement time period. The processor 36 sums the calculated distances for all the time periods to determine the total distance traveled since the last stop. The summation can be a "running" total; i.e., only the current total distance is stored in memory. In other embodiments, each of the incremental distances can be stored in memory and summed after a stop event has been detected. Such an embodiment can be advantageous when the "reference" acceleration value changes due to a change in the orientation of the BHA 22. For example, as shown in FIG. 4C, the reference acceleration value has shifted amount 66. Because the shifted amount 66 increases or decreases the measured acceleration value, the accuracy of the accelerometer measurements and any calculations relying thereon can be adversely affected. Thus, the stored calculated values can be corrected to account for the shift in the reference acceleration value.

The calculated depth measurement may then be compared with a predicted depth measurement. Referring now to FIGS. 1 and 2, the processor 36 may calculate the length of the drill string 20 using the pre-programmed tubular lengths the database 60 of the memory module 38. These lengths can be actual measurements of the tubulars 14 or assumed tubular lengths. In one process, the processor 36 tracks the number of stands or tubular members 14 making up the drill string 20 and sums together the preprogrammed lengths of each individual tubular member 14. By comparing the acceleration-based calculated depth value to the tubular string length summation, the processor 36 can eliminate or reduce the likelihood of erroneous depth determinations. For example, simply monitoring start and stop events and summing individual tubular member lengths may lead to erroneous results if the drill string 20 is stopped for reasons other than to add a tubular joint 14. Also, errors in the accelerometers measurements could accumulate to a point where the accuracy of the summation is compromised. Cross checking the acceleration data based depth with the tubular length based depth may provide a relatively reliable method of determining whether either of the calculated depths are in error.

For example, in an illustrative method utilizing the database 60, the processor 36 may calculate a depth of 80 feet at time T1 using the above-described methodology. T1 is assumed to be a quiet period indicative of the addition of a stand. Because the calculated depth value generally corresponds with the length of stand 1, the processor uses the stand length of 95.32 feet as the determined depth. At time T2, the processor 36 may calculate a depth of 165 feet. Again, because the calculated depth value generally corresponds with the combined lengths of stand 1 and stand 2, the processor uses the combined stand length of 189.44 feet as the determined depth. At time T3, the processor 36 may calculate a depth of 210 feet. However, because the calculated depth value does not correspond with the combined lengths of stand 1, stand 2, and stand 3, the processor 36 does not use the combined stand length of 280.99 feet as the determined depth. That is, in this case, the detected quiet period may not have been related to an addition of a pipe stand. In some embodiments, the processor 36 may include programming to resolve the discrepancies between the predicted depth and the calculated depth. For simplicity, in this embodiment, the processor 36 may store but not otherwise use the depth data for time T3. At time T4, the processor 36 may calculate a depth of 260 feet. Because the calculated depth value generally corresponds with the combined lengths of stand 1, stand 2, stand 3 and stand 4, the processor 36 uses the combined stand length of 280 feet as the determined depth at time T5.

In embodiments, the processor 36 may use interpolation or extrapolation techniques to correct the accelerometer-based depth calculations for depths not included in the database(s) having pre-measured data. For instance, the processor 36 may utilize such a database to increase or decrease a value of a calculated measured depth by interpolating between two predicted depths retrieved from that database.

As should be appreciated, the above methodology may also be utilized with the databases 62 and 64. Moreover, two or more databases, e.g., databases 60 and 62, may be used by the processor 36 to determine depth.

From the above, it should be appreciated that a method of surveying has been described wherein, while the pipe is not moving, a downhole processor performs depth measurement calculations and initiates a static orientation survey station. In casing, the surveys use a gyroscopic survey instrument such as the GYROTRAK tool whereas in open hole a magnetometer may be utilized. The processor computes incremental north, east, and down displacements for the BHA course length based on the inclination and azimuth computed at the beginning and the end of the tubular joint. Thereafter, a summation of the incremental north, east and down displacements produces a set of present total displacement figures for the BHA. The calculations can also be used to determine other values such as true vertical depth. The processor stores the accumulated displacements in the memory module in the downhole MWD/Survey tool. The accumulated data can be transmitted to the surface by sending a special frame of data to the surface via MWD mud pulse after the pumping activity begins, and before drilling resumes. Alternatively, a separate probe-based instrument could be retrieved to the surface using an overshot coupler and a slickline retrieval method. In still other embodiments, the data can be transmitted via suitable conductors in the wellbore. Thus, it should be appreciated that embodiments of the downhole depth determination device can eliminate the need for having survey taken of the wellbore prior to drilling.

It should be understood that the teachings of the present disclosure are not limited to tooling conveyed by rigid carriers such as drill strings, such as that shown in FIG. 1. In embodiments, the above-described methods and devices may be employed on non-rigid carriers such as slick lines. In still other embodiments, the above-described methods and devices may be used in connection with drop survey devices that are released into the wellbore.

The above-described methods and devices in certain embodiments may be employed with devices that take substantially continuous survey measurements of the wellbore. In contrast to discrete intervals for takings surveys, as described in connection with FIG. 3, the processor 36 (FIG. 1) may continuously obtain directional survey data using the on-board direction sensors 40. This survey data with their time-of-day data in memory may be written to the onboard memory module 38 and/or transmitted to the surface. Also, such an arrangement may be used tooling conveyed with a non-rigid carrier (slickline) or tooling dropped into a wellbore, i.e., a drop survey tool. The wellbore tool may also be conveyed by an autonomous wellbore drilling tool such as a tractor device or drilling machine.

While the foregoing disclosure is directed to the preferred embodiments of the invention, various modifications will be apparent to those skilled in the art. It is intended that all variations within the scope of the appended claims be embraced by the foregoing disclosure.

The invention claimed is:

1. A method for determining depth in a wellbore drilled in a subterranean formation, comprising:

forming a database having a selected parameter associated with depth;

programming a memory module of a processor with the database;

conveying a wellbore tool and the processor into the wellbore;

measuring acceleration of the wellbore tool;

determining a predicted depth of the wellbore tool by accessing the database with the processor; and determining the depth of the wellbore tool using the processor by processing the acceleration measurements and using the determined predicted depth of the wellbore tool.

2. The method of claim 1 further comprising surveying the wellbore and associating the survey data with the determined depth.

3. The method of claim 2, wherein the surveying is performed using one of (i) a gyroscopic survey instrument, (ii) a magnetometer, (iii) an accelerometer, (iv) a plumb bob, and (v) a magnetic directional survey instrument.

4. The method of claim 2, wherein the surveying includes values for azimuth and inclination.

5. The method of claim 4, further comprising calculating incremental displacements for north, east, and vertical.

6. The method of claim 1 further comprising: determining an orientation of the wellbore tool at a plurality of discrete locations using a survey tool; and associating the determined orientation with the determined depth for each of the plurality of discrete locations.

7. The method of claim 1 further comprising: continuously determining an orientation of the wellbore tool using a survey tool; and associating the determined orientation with the determined depths for the wellbore tool.

8. The method of claim 1 further comprising: comparing a depth value obtained using the acceleration measurements and the predicted depth of the wellbore tool.

9. The method of claim 1 wherein the memory module is programmed with the database before the wellbore tool is conveyed into the wellbore, and wherein the database includes one of: (i) a measured length of a wellbore tubular; (ii) a measured parameter of a naturally occurring feature; and (iii) a measured parameter of a human made feature in the wellbore.

10. The method of claim 1 wherein the memory module is programmed with the database before the processor is conveyed into the wellbore; and further comprising calculating the predicted depth of the wellbore tool at a plurality of locations in the wellbore using the database and comparing the predicted depth to a depth value determined using the accelerometer measurements.

11. A system for determining depth in a wellbore drilled in a subterranean formation, comprising:

a drill string configured to convey a bottomhole assembly (BHA) into the wellbore;

an accelerometer positioned on the drill string;

a memory module programmed with data relating to a previously measured parameter of interest; and a processor in communication with the accelerometer and the memory module, the processor configured to:

determine a predicted depth of the wellbore tool by using the data in the memory module; and determine the depth of a selected location on the BHA using measurements made by the accelerometer and the determined predicted depth of the wellbore tool.

12. The system of claim 11 further comprising a survey tool positioned on the drill string, and wherein the processor is configured to associate measurements of the survey tool with the determined depth.

13. The system of claim 12 wherein the survey tool is one of (i) a gyroscopic survey instrument, (ii) a magnetometer, (iii) accelerometer, (iv) a plumb bob, and (v) a magnetic directional survey instrument.

14. The system of claim 12, wherein the survey tool measures one of:

azimuth and inclination.

15. The system of claim 11 wherein the processor is configured to determine an orientation of the BHA at a plurality of discrete locations using a survey tool; and associate the determined orientation with the determined depth for each of the plurality of discrete locations.

16. The system of claim 11 wherein the processor is configured to continuously determine an orientation of the wellbore tool using a survey tool and associate the determined orientation with the determined depths for the BHA.

17. The system of claim 11 wherein the processor is configured to determine a first depth value by processing the accelerometer measurements, access the database to obtain a second depth value, and compare the first depth value to the second depth value to determine the depth of the BHA.

18. The system of claim 11 wherein the database includes one of: (i) a measured length of a wellbore tubular; (ii) a measured parameter of a naturally occurring feature; and (iii) a measured parameter of a human made feature in the wellbore.

19. The system of claim 11 wherein the memory module is preprogrammed with data before the processor is conveyed into the wellbore; and wherein the processor is configured to calculate the predicted depth of the wellbore tool at a plurality of locations in the wellbore by comparing the predicted depth to the depth value determined using the accelerometer measurements.

20. An apparatus for determining depth in a wellbore drilled in a subterranean formation, comprising:

a drilling tubular;

a wellbore tool conveyed by the drilling tubular into the wellbore;

an accelerometer positioned on the wellbore tool;

a memory module programmed with data relating to a previously measured parameter of interest; and a processor in communication with the accelerometer and the memory module, the processor being configured to:

determine a predicted depth of the wellbore tool using the data in the memory module; and determine the depth of the wellbore tool using measurements made by the accelerometer and the determined predicted depth of the wellbore tool.

21. The apparatus of claim 20 wherein the previously measured parameter of interest includes a length of a tubular making up the drilling tubular conveying the wellbore tool into the wellbore.

22. The apparatus of claim 20 wherein the memory module is preprogrammed with data before the processor is conveyed into the wellbore; and wherein the processor is configured to calculate the predicted depth of the wellbore tool at a plurality of locations in the wellbore by comparing the predicted depth to the depth value determined using the accelerometer measurements.

* * * * *